United States Patent [19]

Stüber

[11] 4,056,926

[45] Nov. 8, 1977

[54] METHOD AND APPARATUS FOR DETECTING SO-CALLED MOIRE EFFECT DURING SPINNING

[75] Inventor: Wolfgang Stüber, Dettenhausen, Germany

[73] Assignee: Otto Stüber KG, Bissingen, Germany

[21] Appl. No.: 693,151

[22] Filed: June 7, 1976

[30] Foreign Application Priority Data

June 7, 1975 Germany ..... 2525461

[51] Int. Cl.[2] ..... D01H 13/22

[52] U.S. Cl. ..... 57/81; 28/227; 57/156

[58] Field of Search ..... 57/34 R, 78–81, 57/156; 28/64; 226/1

[56] References Cited

U.S. PATENT DOCUMENTS

| | | | |
|---|---|---|---|
| 3,030,853 | 4/1962 | Strother | 28/64 |
| 3,124,289 | 3/1964 | Lynch et al. | 28/64 UX |
| 3,185,924 | 5/1965 | Locher | 28/64 |
| 3,276,227 | 10/1966 | Althaus et al. | 57/81 X |
| 3,309,754 | 3/1967 | Metcalf | 28/64 |
| 3,438,188 | 4/1969 | Boggs | 57/81 |
| 3,477,021 | 11/1969 | Dosch et al. | 28/64 X |
| 3,557,615 | 1/1971 | Seymour et al. | 28/64 X |
| 3,673,591 | 6/1972 | Schwartz | 57/81 X |

*Primary Examiner*—Donald Watkins

*Attorney, Agent, or Firm*—McGlew and Tuttle

[57] ABSTRACT

In the method, the number of defective portions of the yarn, occurring at periodic spacings within a predetermined time period, is detected to provide a detected value. This detected value is compared with a predetermined desired value of the number of defective portions within such predetermined time period. If the detected value exceeds the desired value, an output signal is provided or released to a stop device, control device, or the like of the spinning machine. The device comprises a thread monitor connected to a pulser which produces pulses responsive to variations in the yarn thickness. The output of the pulser is supplied to a thick portion monitor which detects long pulses produced responsive to relatively long defects in the yarn, and the thick portion monitor is connected to a time switch which, in turn, is connected to a signalling device, stop device, or control device for the spinning machine. A moire monitor is connected, in parallel with the thick portion monitor, between the pulser and the time switch, and detects short pulses produced by the pulser responsive to the periodically occurring defective portions of the yarn. In one embodiment of the invention, the moire monitor comprises a RC circuit receiving the pulses and connected with an additional resistor. In another embodiment of the invention, the moire monitor comprises a counter and a timing pulse generator.

8 Claims, 1 Drawing Figure

METHOD AND APPARATUS FOR DETECTING SO-CALLED MOIRE EFFECT DURING SPINNING

FIELD AND BACKGROUND OF THE INVENTION

The present invention relates to a method of detecting the so-called moire effect during spinning of yarns and the like, as well as to a device for carrying out this method.

To an ever increasing extent, spinning with spindles is being replaced by the spindle-less spinning method using a rotor. This new rotor spinning method entails new spinning defects in the spun threads or yarns, and which have been unknown before. Such defects occur periodically, for example, due to the fact that, at a certain location on the inside of the rotor, an adhesion by resin or the like takes place, and thickened and thinned, regularly spaced portions are produced in the thread or yarn, resulting from a material displacement caused by the local pressure in the resined zones. It is clear that the periodic location of such a defect depends on the respective circumference of the rotor. In this connection, one speaks of the so-called "moire effect."

In spinning processes with spindles, periodically occurring defects, or the moire effect, respectively, have not yet been observed. In such processes, it is rather individual thicker and thinner portions which occur at irregular distances, and special devices have been developed for monitoring those defects. As soon as such a thickened or thinned portion exceeds a predetermined size, the defect is indicated by an associated thread monitoring device. Thereupon, suitable measures are taken, for example, the thread is cut, the defective portion is removed and the two ends of the thread are connected again. Thread monitoring devices of the prior art are designed so that only individual defective portions, i.e., variations of the cross section of the thread, which have a certain length and exceed the admitted tolerence, are taken into account.

The so-called "moire effect" means that each thickened or thinned portion extends over only a short length of the thread so that, while using known thread monitoring devices, the indication of the defects is suppressed, irrespective of their thickness.

SUMMARY OF THE INVENTION

The present invention is directed to a method and device making it possible to detect, and at least indicate, the moire effect occurring, particularly, in the rotor spinning process.

In accordance with the invention, a method is provided in which the number of defective portions of the yarn or the like, occurring at periodic distances within a predetermined period of time, is determined or detected, is compared with a desired value, and, upon the exceeding of a predetermined number of defects, a signal is released and/or a stop device, control device, or the like, of the spinning machine, is actuated. Thus, for example, if fifteen periodically recurring defects are considered the maximum admissible number for a predetermined length of the yarn or thread, the signal is released and/or a suitable intervention into the spinning process takes place as soon as 15 defects are actually detected over that length. If, on the contrary, less than 15 defects are detected, there is no indication nor, for example, a stopping of the spinning machine. Instead, the counting of the sequence of defects is interrupted and the counting starts again from the beginning. After the yarn has reached a certain running speed, a predetermined period of time for a given spinning machine, of course, corresponds to a respective length of the yarn. For this reason, with one and the same spinning machine, there is an equivalence between the determination of a period of time and the determination of a yarn length.

A device for carrying out this method, and including a thread monitoring unit with a pulser connected to a time switch which, in turn, is connected to a signalling device, stop device, or control device, or the like for the spinning machine, comprises, in accordance with the invention, a moire monitoring device which is connected between the pulser of the thread monitoring unit and the time switch. Thus, the thread monitoring unit detects the thickened and thinned portions in a well known manner and, with the aid of the pulser, produces corresponding, suitable pulses. These pulses may now be transmitted, as hitherto, to a monitoring device which is responsive only to pulses corresponding to a thickening or thinning of sufficient distinctness and length.

In accordance with the invention, these pulses are, in addition, transmitted to a moire monitoring device which is capable of evaluating the short, recurring pulses produced at the occurrence of a moire effect. In the moire monitoring device the incoming series of pulses is checked and only those pulses which are of sufficient strength and number are selected, which may be done by presetting the respective desired values. As soon as such pulse train arrives and has been evaluated, the moire monitoring device delivers a control signal or impulse to the mentioned time switch. With a parallel connection of a moire monitoring device and a thick-portion monitoring device, the time switch receives a control signal or pulse in a well known manner as soon as a thickened portion having a sufficient length and intensity is detected. The time switch evaluates the received signals, actuates an acoustic and/or optical defect indication and, if provided, also a stopping mechanism or a corresponding control of the spinning machine. The same applies analogously if a periodic defect of a predetermined thickness and length occurs.

In accordance with a development of the invention, the moire monitoring device comprises an RC network in which an additional resistor is connected in parallel to the capacitor. The periodic pulses caused by the moire effect charge the capacitor through the resistor of the RC network until the capacitor delivers its charge. The charge flow off through the additional resistor. Advantageously, the additional resistor is adjustable so that the current can be choked more or less. In this manner, a variable time constant is obtained.

In another variant of the invention, the moire monitoring device comprises a counter which is connected to the pulser of the thread monitoring device and also connected to a timing pulse generator. The timing pulse generator can be switched on by the pulser, and comprises a start-stop mechanism for the counter. Upon attaining a desired value, the counter delivers a signal to the time switch. Here again, the design is such that, in the thread monitoring device, the defects are detected and the following pulser delivers corresponding pulses. The short periodic pulses, which are not evaluated in a preferably provided thick-portion monitoring device, pass also or only to the counter where they are counted. As soon as the first pulse arrives, the timing pulse generator is started by that pulse and, in turn, starts the counter. Upon expiration of a time delay adjusted in the timing pulse generator, the generator stops the counter again.

Further, a desired value is adjusted in the counter. As soon as the predetermined desired number of pulses is attained within the time delay of the timing pulse generator or the counter, the counter delivers a signal, for example, an electric impulse, to the mentioned time switch which, in turn, releases an optical or acoustic signal or intervenes in the spinning process. If, within the delay time, the detected number of pulses which, of course, corresponds to the number of periodic defects in the thread or yarn, does not attain the predetermined adjusted value, the timing pulse generator stops automatically upon expiration of the delay time, whereby the counter is also stopped and reset to zero. Upon occurrence of the next short pulse, the timing pulse generator and the counter are started again. The desired value may be adjusted in the counter in an appropriate known manner. Further, as already mentioned, the timing pulse generator is equipped with a start-stop mechanism by which both the generator and the counter are stopped after expiration of the delay time. In accordance with another feature of the invention, this start-stop mechanism of the timing pulse generator is also adjustable.

An object of the invention is to provide an improved method for detecting the so-called "moire effort" during spinning of yarns and the like.

Another object of the invention is to provide a device for carrying out the method.

A further object of the invention is to provide such a method and device which may be used in association with a known thick-portion monitoring device for yarn.

For an understanding of the principles of the invention, reference is made to the following description of typical embodiments thereof as illustrated in the accompanying drawing.

DESCRIPTION OF THE PREFERRED EMBODIMENTS

Figure 1:
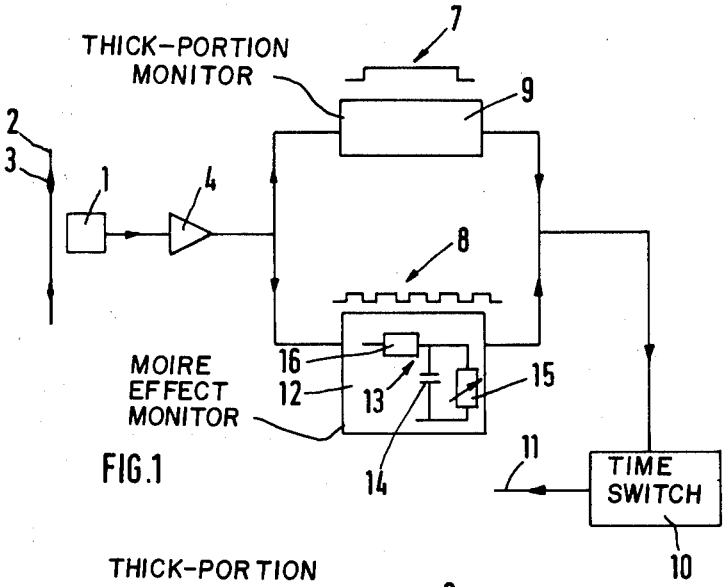
FIG. 1 is a block diagram of a first embodiment of the invention device.

Referring to the drawing, a thread monitoring device 1 of conventional design is used for checking whether the thread or yarn 2 is of satisfactory quality or has defects, for example, in the form of thickened portions 3 or thinned portions. In a rotor spinning process, such thickened portions may occur periodically. The thickened or thinned portions of the thread are detected by the thread monitoring device 1 whose input is converted and transmitted, by means of a following pulser 4, in the form of corresponding pulses.

Considered in the longitudinal direction of the yarn, long defects 5 result in the production of a long pulse 7, while periodically occurring short defects 6 result in a periodic series of short individual pulses 8. A thick-portion monitoring device 9, which may be used also along with the inventive device for detecting the so-called moire effect causing the series of short pulses, acts in the manner of a filter selecting, from all the pulses delivered by the pulser, those having a predetermined length and intensity. As soon as such a pulse 7 occurs, this fact is signalled by thick-portion monitoring device 9 to a time switch 10. The signal may be an electric pulse. Time switch 10 transforms the relatively short output signal of thick-portion monitoring device 9 into a signal of appropriate length which is suitable for actuating an optical or acoustic indicator for a sufficiently long time, or for intervening in the spinning process, for example, by stopping the respective rotor of the spinning machine. The output of time switch 10, or a corresponding line to the mentioned indicator or rotor drive, is indicated by a line 11.

The periodically occurring short pulses, thus the pulse train 8, can be detected, in accordance with the invention, by means of a moire monitoring device 12. As soon as the pulses are sufficiently strong and the pulse train extends through an adequate period of time, moire monitoring device 12 delivers a corresponding control signal to time switch 10 which is then put in operation in the already mentioned manner.

In the embodiment of FIG. 1, moire monitoring device 12 comprises an RC network 13 including a capacitor 14 which is connected to an additional, preferably adjustable resistor 15. Through resistor 16 of RC network 13, capacitor 14 is gradually charged by the pulses of pulse train 8. Upon attaining a predetermined charge, capacitor 14 discharges through additional resistor 15. The time constant can be varied by varying the resistance of additional resistor 15. In this manner, a sort of counting operation takes place in moire monitoring device 12, i.e., the pulses are added. Upon accumulating a predetermined number of pulses within an also predetermined period of time which is given by the capacitance of capacitor 14 and the discharge resistance 15, moire monitoring device 12 delivers a pulse or control signal to time switch 10 where the signal is evaluated in the already mentioned manner.

Figure 2:
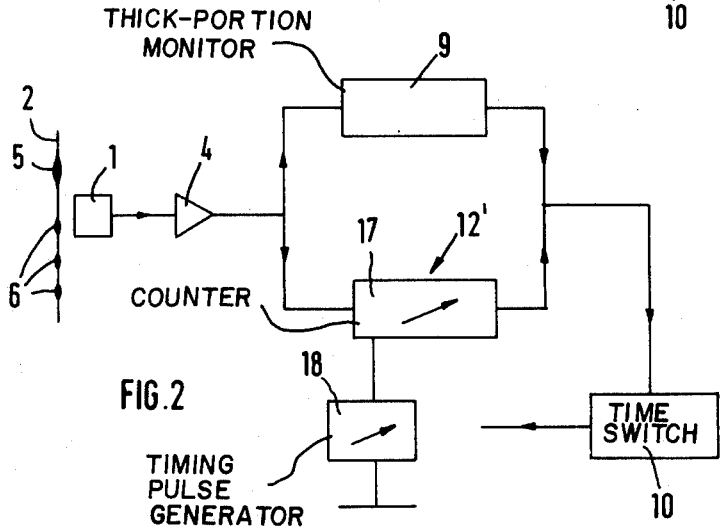
FIG. 2 is a block diagram of a second embodiment of the invention device.

In the embodiment shown in FIG. 2, the thickened or thinned portions or, in general, defects 5 and 6 are again detected by means of a thread monitoring device 1 by which a pulser 4 is actuated. In this case, the resulting pulses may again be directed through a thick-portion monitoring device 9, on the one hand, and a moire monitoring device 12' on the other hand. However, the monitoring device 12' is designed in a manner different from that shown in FIG. 1.

Device 12' comprises a counter 17 to which the pulses are supplied. Simultaneously operating is a timing pulse generator 18 running freely at a predetermined frequency, which, in particular, is adjustable. In case the number of pulses received in counter 17 within the predetermined timing cycle exceeds a predetermined value, following time switch 10 is again actuated.

As soon as, within the delay time of timing pulse generator 18 and, thereby, also of counter 17, the actual value attains the desired one, a control signal or pulse is delivered to time switch 10 which is then actuated in the above described manner. If, on the contrary, the actual value does not reach the desired value within the delay time of timing pulse generator 18, which means a too small number of pulses per unit of time, no control signal is transmitted to time switch 10 and counter 17 is automatically reset to zero.

While specific embodiments of the invention have been shown and described in detail to illustrate the application of the principles of the invention, it will be understood that the invention may be embodied otherwise without departing from such principles.

What is claimed is:

1. A method of detecting the so-called moire effect, in addition to detecting relatively long variations in yarn thickness, during spinning of yarns and the like comprising the steps of detecting relatively long variations in yarn thickness; responsive to such detection, providing an output signal for control of the spinning machine; in addition, simultaneously detecting the entire number of defective portions of the yarn, occurring at periodic spacings within a predetermined time period, to provide a detected value; comparing the detected number with a predetermined desired value of the number of defective portions of the yarn within such predetermined time period; and, responsive to such detected number exceeding such desired value, also providing an output signal for control of the spinning machine.

2. In a device for detecting defective portions of yarn, during spinning of yarn and the like by a spinning machine, of the type having a thread monitoring unit for detecting relatively long variations in the thickness of the yarn and including a pulser connected to a time switch, and, responsive to detection of such relatively long variations in the yarn thickness, providing an output signal for control of the spinning machine: a moire monitoring device, operable to detect the number of defective portions of the yarn, occurring at periodic spacings within a predetermined time period, connected between said pulser and said time switch and operable to activate said time switch to provide said output signal responsive to the number of detected defective portions of the yarn occurring within such predetermined time period exceeding a desired value.

3. A moire monitoring device, as claimed in claim 2, comprising an RC network including a network resistor and a network capacitor; and an additional discharging resistor connected in parallel with said network capacitor.

4. A moire monitoring device, as claimed in claim 3, in which said additional resistor is adjustable.

5. A moire monitoring device, as claimed in claim 2 comprising a counter connected to said pulser; and a timing pulse generator connected to said counter; said counter, upon attaining a desired value, delivering an actuating signal to said time switch to provide said output signal.

6. A moire monitoring device, as claimed in claim 5, in which the desired value of said counter is adjustable.

7. A moire monitoring device, as claimed in claim 5, in which said timing pulse generator has an adjustable pulse frequency.

8. A moire monitoring device, as claimed in claim 2, including a thick-portion monitor connected between said pulser and said time switch in parallel with said moire monitoring device and operable to activate said time switch to provide said output signal responsive to detection of a yarn defect exceeding a predetermined relatively large length.

* * * * *